US005106088A

United States Patent [19]

Saito

[11] Patent Number: 5,106,088

[45] Date of Patent: Apr. 21, 1992

[54] IRON OR WOOD GOLF CLUB

[76] Inventor: Tatsuya Saito, 4-21-4 Seijo, Setagaya-ku, Tokyo, Japan

[21] Appl. No.: 611,297

[22] Filed: Nov. 9, 1990

[30] Foreign Application Priority Data

Nov. 10, 1989 [JP] Japan ..... 1-130609[U]

[51] Int. Cl.[5] ..... A63B 53/02

[52] U.S. Cl. ..... 273/80 C; 273/77 A; 273/167 G; 273/164

[58] Field of Search ..... 273/164, 77 A, 80 C, 273/162 R, 163 R, 163 A, 167 A, 167 F, 167 G

[56] References Cited

U.S. PATENT DOCUMENTS 1,409,966 3/1922 Plant ..... 273/164

3,539,184 11/1970 Koorland ..... 273/77 A

*Primary Examiner*—George J. Marlo

*Attorney, Agent, or Firm*—Merchant, Gould, Smith, Edell, Welter & Schmidt

[57] ABSTRACT

The present invention discloses an iron or wood golf club head 10 designed to strike a golf ball so that it flies straight in a desired direction. The golf club head 10 consists generally of a striking surface 11, including a leading edge 12, and a hosel member 15, which provides a socket for insertion of a shaft member 19. The hosel member 15 extends from the striking surface 11 at a substantially perpendicular angle relative to the leading edge 12.

3 Claims, 5 Drawing Sheets

PRIOR ART

IRON OR WOOD GOLF CLUB

BACKGROUND OF THE INVENTION

1. Field of the Invention

This invention relates generally to a golf club head, and more particularly, to a golf club head designed to strike a golf ball so that it flies straight in a desired direction.

2. Description of the Art

A typical set of golf clubs includes a putter and several clubs that are generally referred to as "woods" and "irons." A golfer selects a particular club for a given shot according to the distance to the hole and the "lie" of the golf ball. Each club in the set is designed for hitting the ball a particular distance and from a particular lie. However, in striking the golf ball, many golfers have difficulty consistently hitting the ball straight in a desired direction, and this difficulty may be a function of the particular structure of the conventional golf club head.

A conventional golf club head 50 is shown in FIG. 5. The conventional golf club head 50 includes a striking surface 51, having a leading edge 52. A toe member 53 and a heel member 54 are integrally connected to opposite ends of the striking surface 51, and a hosel member 55 is integrally connected to the heel member 54. The golf club head 50 is said to have a face 56, which comprises the visible portions of the striking surface 51, the toe member 53, and the heel member 54, as shown in FIG. 5. The hosel member 55, which provides a socket into which a shaft member 59 is inserted, extends from the heel member 54 at an oblique angle relative to the leading edge 52.

The configuration of the conventional golf club head makes it difficult to effectively transfer force through the club to the golf ball. In particular, the force transmitted from the golfer's swing tends to distribute unevenly across the face 56 of the club, with greater force in the heel member 54 and less force in the toe member 53. The uneven distribution of force and resulting moment forces make it difficult to control the orientation of the club head 50, and as a result, the ball tends to deviate from the desired direction upon impact and/or during flight, causing shots that may be termed "push", "pull", "slice", and "hook".

Attempts have been made to compensate for the uneven distribution of moment forces, but without success. Such attempts have included adding weight to the toe member 53, changing the configuration of the club head, increasing the weight and rotational moment of the club shaft, and/or adjusting the grip on the club.

SUMMARY OF THE INVENTION

The present invention provides a golf club head having a striking surface, including a leading edge, and a hosel member connected to the striking surface and extending substantially perpendicularly from the striking surface relative to the leading edge. The substantially orthogonal relationship between the leading edge of the striking surface and the hosel member and thus, the club shaft, gives rise to substantially uniform forces across the face of the club head, giving the golfer greater control over the club and increasing the likelihood that the ball will fly straight in a desired direction.

BRIEF DESCRIPTION OF THE DRAWING

Referring to the Figures, wherein like numerals represent like parts throughout the several views.

DETAILED DESCRIPTION OF THE PREFERRED EMBODIMENT

Figure 1:
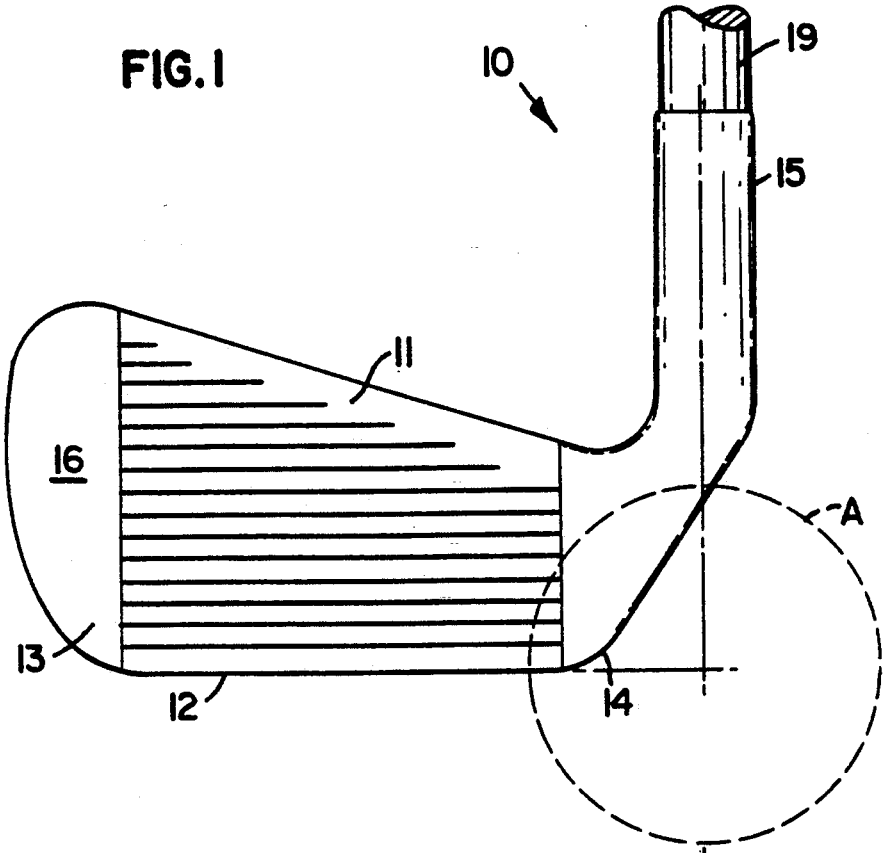
FIG. 1 is a front view of a preferred embodiment of a golf club head according to the present invention.
Figure 6:
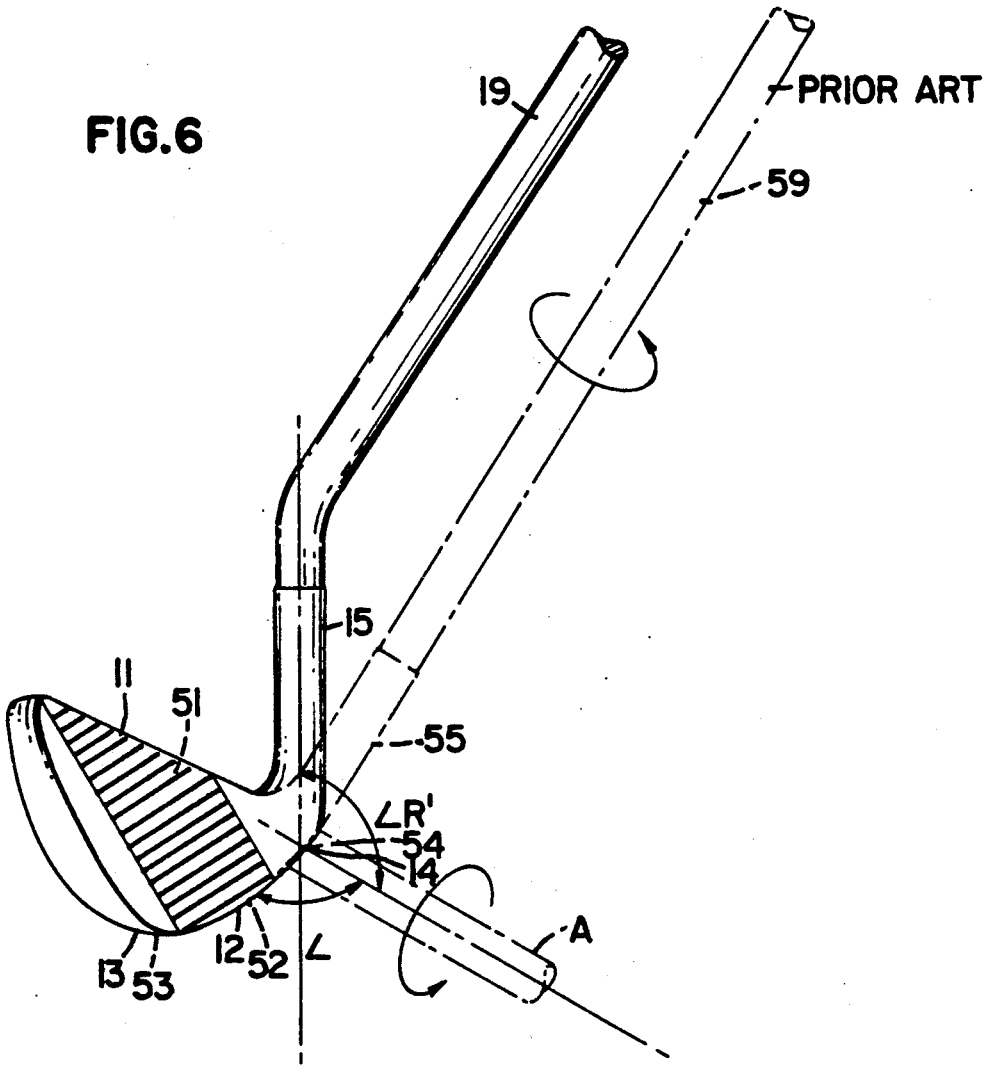
FIG. 6 is perspective view of the golf club head of FIG. 1 superimposed upon the golf club head of FIG. 5.

Referring to FIG. 1, a preferred embodiment of a golf club head according to the present invention is designated at 10. The golf club head 10 includes a striking surface 11 having a leading edge 12. A toe member 13 and a heel member 14 are integrally connected to opposite ends of the striking surface 11, and a hosel member 15 is integrally connected to the heel member 14. The golf club head 10 has a face 16, which comprises the visible portions of the striking surface 11, the toe member 13, and the heel member 14, as shown in FIG. 1. The hosel member 15, which provides a socket into which a shaft member 19 is inserted, extends from the heel member 14 at an approximately perpendicular angle relative to the leading edge 12. As shown in FIG. 6, the shaft member 19 includes a first shaft portion 21 and a second shaft portion 22, which define an obtuse angle therebetween. The first shaft portion 21 is secured to and extends from the hosel member 15 substantially perpendicular to the leading edge 12. The obtuse angle or bend in the shaft member 19 is such that the second shaft portion 22 extends away from the club head 10.

The substantially orthogonal relationship between the hosel member 15 and the leading edge 12 increases the likelihood that the ball will fly straight in the desired direction when struck. Applicant offers the following paragraphs as explanation.

Figure 2:
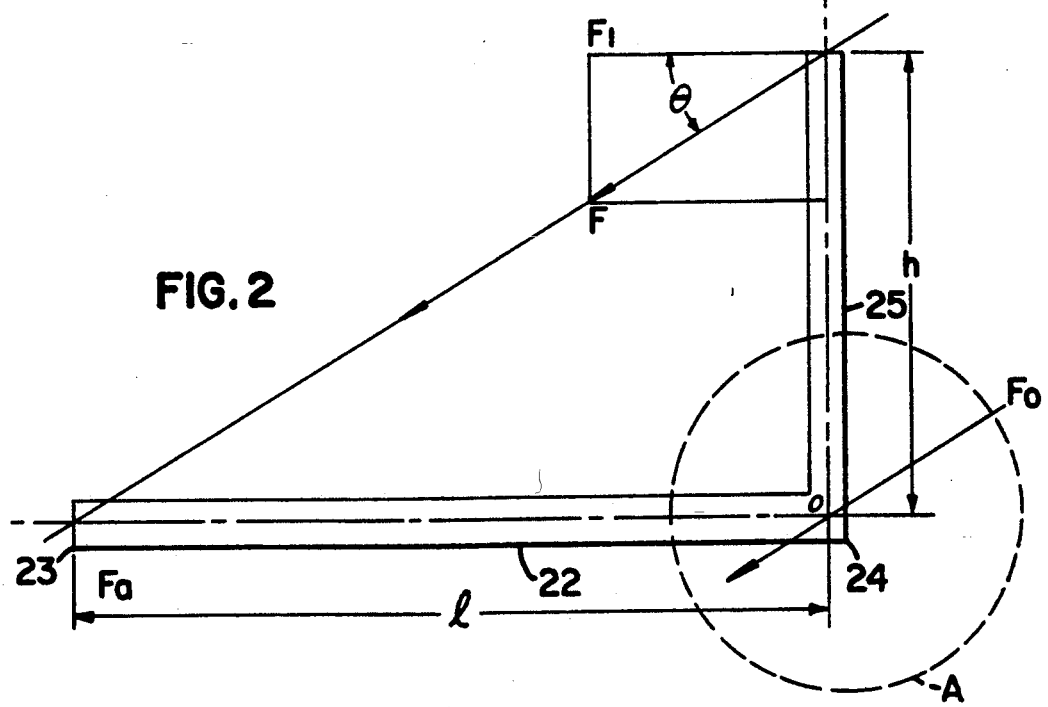
FIG. 2 is a schematic illustration of the theoretical distribution of force at points from the toe (23) to the heel (24) along the golf club head of FIG. 1.

Referring to FIG. 2, $F_1$ = the horizontal component of centrifugal force F in the club head 10 when the golf club is swung downward "through" a golf ball;

h = the height of the hosel member 15 as measured relative to the leading edge 12; and l = the length of leading edge 12 as measured relative to center line of hosel member 15; and $$\tan\theta = \left(\frac{h}{l}\right)$$

$F_a$ = the downward directed force generated at the leading edge 12

Varying 1 to measure the force at points along the leading edge 12, $$f_1 = F_1 \frac{h_1}{l_1} = \frac{h_1}{l_1} F \cos\theta$$
$$= F \cdot \left( \frac{h_1}{l_1} \cdot \cos\theta \right)$$

$F_1 = F \cos\theta$ and $M = h \cdot F_1 = h \cdot F \cos\theta$.

At the O point in FIG. 2, $M = h\ (=o) \cdot F \cos\theta = 0$

Figure 3:
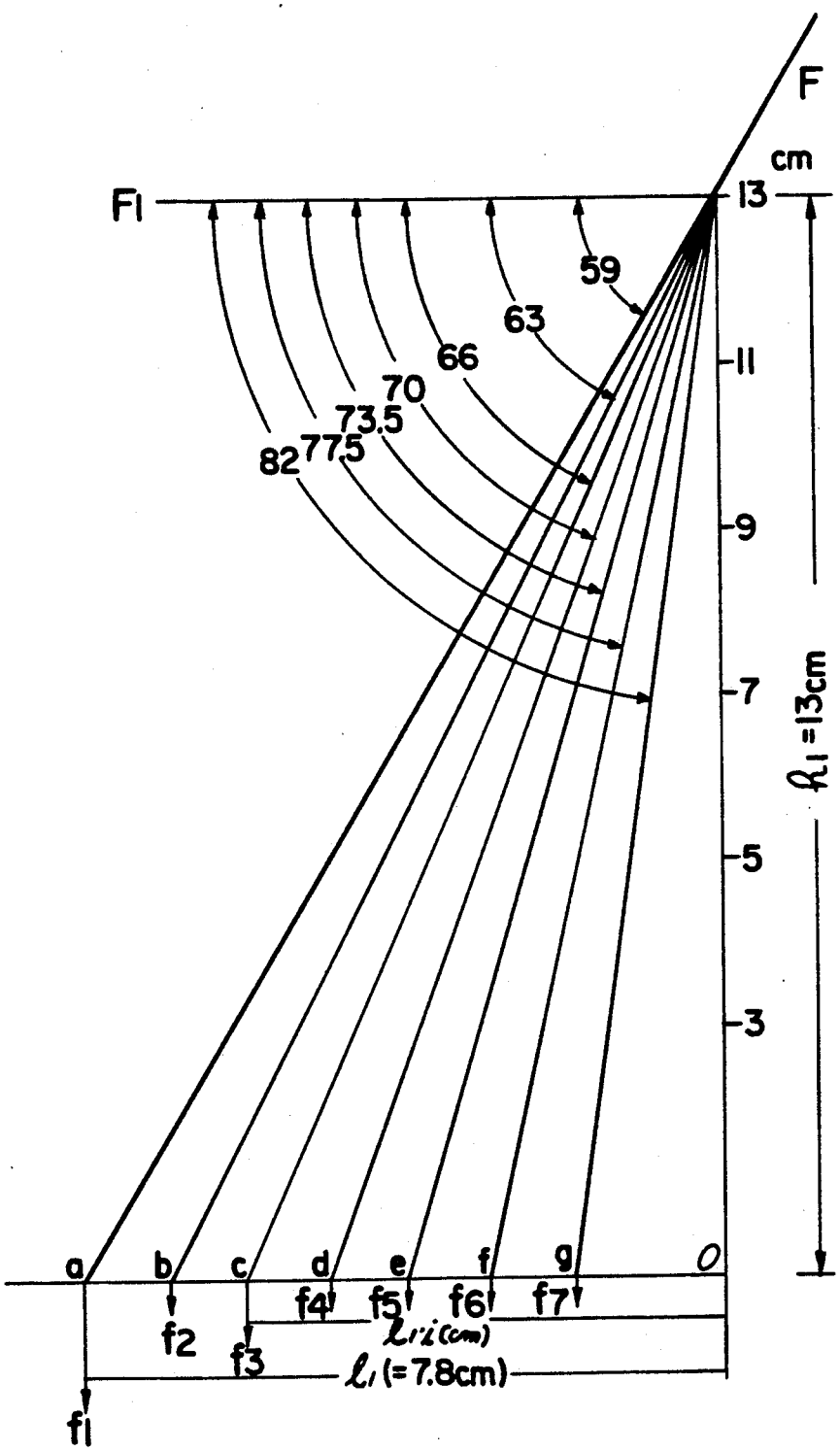
FIG. 3 is a schematic illustration of the theoretical distribution of downward force at points from the toe (a) to the heel (g) along the leading edge of the golf club head of FIG. 1.

Referring to FIG. 3, $$f_1 = F_1 \frac{h_1}{l_1} = \frac{h_1}{l_1} F \cos\theta$$
$$= F \cdot \left( \frac{h_1}{l_1} \cdot \cos\theta \right)$$

$M = F \cdot h_1 = f_1 \cdot l_1$ $$f_i = F \cdot \left( \frac{h_1}{l_{1-i}} \cdot \cos\theta_1 \right)$$

Provided, $i = 1—7$ (such that 1 is varied to correspond to points along the leading edge 12); and $f_i$ = downward force along the leading edge 12.

$$f_{1-7} = F \cdot \left( \frac{h}{l_{1-7}} \cdot \cos\theta_{1-7} \right) \text{ and where } h = 13,$$

$$f_1 = F \cdot \left( \frac{13}{7.8} \cdot \cos 59 \right) = F \cdot (1.67 \times 0.515) \approx 0.86\,F$$

$$f_2 = F \cdot \left( \frac{13}{6.8} \cdot \cos 63 \right) = F \cdot (1.91 \times 0.454) \approx 0.87\,F$$

$$f_3 = F \cdot \left( \frac{13}{5.8} \cdot \cos 66 \right) = F \cdot (2.24 \times 0.407) \approx 0.91\,F$$

$$f_4 = F \cdot \left( \frac{13}{4.8} \cdot \cos 70 \right) = F \cdot (2.70 \times 0.347) \approx 0.91\,F$$

$$f_5 = F \cdot \left( \frac{13}{4.8} \cdot \cos 73.5 \right) = F \cdot (3.42 \times 0.284) \approx 0.97\,F$$

$$f_6 = F \cdot \left( \frac{13}{2.8} \cdot \cos 77.5 \right) = F \cdot (4.64 \times 0.216) \approx 1.00\,F$$

$$f_7 = F \cdot \left( \frac{13}{1.8} \cdot \cos 82 \right) = F \cdot (7.22 \times 0.139) \approx 1.00\,F$$

Figure 4:
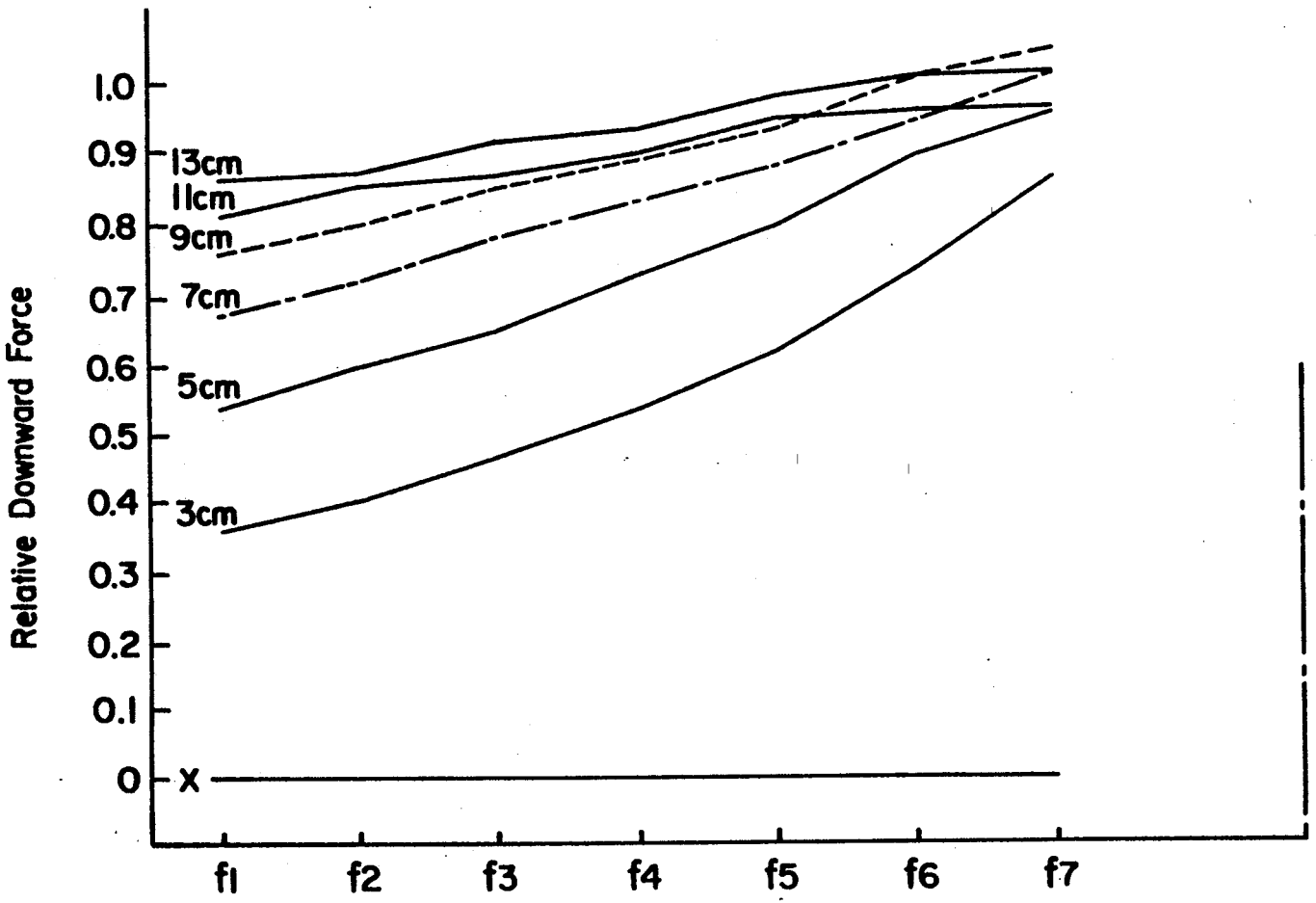
FIG. 4 is a graph of the relative values of downward force at points from the toe ($f_1$) to the heel ($f_7$) along the leading edge of the golf club head of FIG. 1, for hosel members ranging in length from 3 cm to 13 cm.
Figure 5:
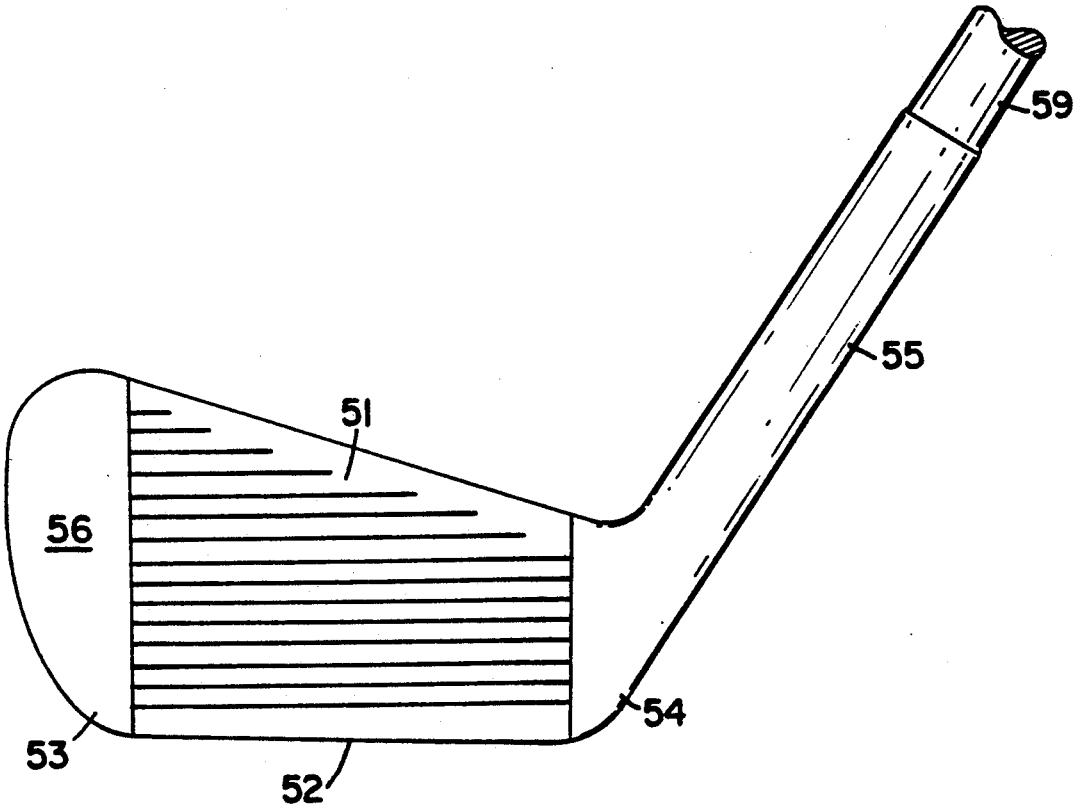
FIG. 5 is a front view of a conventional golf club head.

As shown in FIG. 4, which plots the relative downward force along points $f_1$–$f_7$ of the leading edge 12 for hosel members is varying in height from 3 cm to 13 cm, there are relatively constant downward forces along the leading edge 12 of the golf club head 10 of the present invention. The relatively consistent downward forces act to limit any tendency of the golf club to twist. In comparison, there are no such downward forces on the leading edge of the conventional club head (labeled as X in FIG. 4).

Referring to FIG. 6, the center of an imaginary cylinder A passes through the intersection of the center line of the hosel member 15 and the extension of the leading edge 12, such that ANGLE $R^1$ is equivalent to ANGLE R. The moment shown about the imaginary cylinder A corresponds to the moment upon the club head 10 generated by swinging the club. The almost perpendicular relationship between the hosel member 15 and the leading edge 12 causes the moment force to be distributed over the entire golf club head 10.

A golf club fitted with the golf club head 10 of the present invention is less likely to twist in the golfer's hands due to the moment force generated over the entire golf club head 10, and the relatively evenly distributed downward forces, which press against the ground substantially uniformly across the leading edge 12. Thus, a golfer using such a club is more likely to strike the ball in such a manner that the ball flies straight in a desired direction.

While this invention has been described with regard to a preferred embodiment, it is not to be limited thereby, but only by the appended claim.

What is claimed is:

1. An improved golf club other than a putter, wherein the improvement lies in an orthogonal relationship between the leading edge of the club head and the hosel member, and a bend in the shaft of said club proximate the hosel member and away from the club head.

2. An improved golf club of a type commonly known as an iron, comprising:

(a) a club head, including a striking surface having a leading edge;

(b) a hosel member connected to said club head and extending from said club head substantially perpendicular to said leading edge; and (c) a shaft member, including a first shaft portion secured to and extending from said hosel member substantially perpendicular to said leading edge, and a second shaft portion secured to and extending from said first shaft portion at an obtuse angle relative to said first shaft portion and away from said club head.

3. An improved golf club of a type commonly known as an wood, comprising:

(a) a club head, including a striking surface having a leading edge;

(b) a hosel member connected to said club head and extending from said club head substantially perpendicular to said leading edge; and (c) a shaft member, including a first shaft portion secured to and extending from said hosel member substantially perpendicular to said leading edge, and a second shaft portion secured to and extending from said first shaft portion at an obtuse angle relative to said first shaft portion and away from said club head.

* * * * *

UNITED STATES PATENT AND TRADEMARK OFFICE

CERTIFICATE OF CORRECTION

PATENT NO. : 5,106,088

DATED : April 21, 1992

INVENTOR(S) : Tatsuya Saito

It is certified that error appears in the above-identified patent and that said Letters Patent is hereby corrected as shown below:

In column 3, please delete the formula at line 26 and substitute therefore

-- $M = F_1 \cdot h_1 = f_1 \cdot l_1$ --

Signed and Sealed this

Eighteenth Day of January, 1994

*Attest:*

Bruce Lehman

BRUCE LEHMAN

*Attesting Officer*

*Commissioner of Patents and Trademarks*